US007708843B2

(12) United States Patent
Laurent et al.

(10) Patent No.: US 7,708,843 B2
(45) Date of Patent: May 4, 2010

(54) METHOD FOR MAKING A COATED STEEL PART HAVING VERY HIGH RESISTANCE AFTER HEAT TREATMENT

(75) Inventors: Jean-Pierre Laurent, Istres (FR); Jacques Devroc, Arles (FR)

(73) Assignee: ArcelorMittal France, Saint-Denis (FR)

( * ) Notice: Subject to any disclaimer, the term of this patent is extended or adjusted under 35 U.S.C. 154(b) by 32 days.

(21) Appl. No.: 11/908,206

(22) PCT Filed: Mar. 2, 2006

(86) PCT No.: PCT/FR2006/000466

§ 371 (c)(1),
(2), (4) Date: Feb. 26, 2008

(87) PCT Pub. No.: WO2006/097593

PCT Pub. Date: Sep. 21, 2006

(65) Prior Publication Data

US 2008/0283156 A1 Nov. 20, 2008

(30) Foreign Application Priority Data

Mar. 11, 2005 (FR) ..... 05 02404

(51) Int. Cl.
*C21D 8/02* (2006.01)

(52) U.S. Cl. ..... 148/518; 148/531; 148/535

(58) Field of Classification Search ..... 148/518, 148/531

See application file for complete search history.

(56) References Cited

U.S. PATENT DOCUMENTS

| | | | | |
|---|---|---|---|---|
| 3,214,820 | A | 11/1965 | Smith, et al. | |
| 6,197,132 | B1 * | 3/2001 | Andersson-Drugge | 148/524 |
| 6,296,805 | B1 * | 10/2001 | Laurent et al. | 420/104 |

FOREIGN PATENT DOCUMENTS

| | | |
|---|---|---|
| DE | 1 290 024 | 2/1969 |
| DE | 102 24 319 | 12/2003 |
| EP | 1 013 785 | 6/2000 |
| EP | 1 403 388 | 3/2004 |
| FR | 857 779 | 9/1940 |
| GB | 1 489 618 | 10/1977 |
| WO | 99 55469 | 11/1999 |

* cited by examiner

*Primary Examiner*—George Wyszomierski
(74) *Attorney, Agent, or Firm*—Oblon, Spivak, McClelland, Maier & Neustadt, L.L.P.

(57) ABSTRACT

The invention relates to a process for manufacturing a part having very high mechanical properties from a hot-rolled or cold-rolled steel strip, comprising precoating said strip with aluminum or an aluminum alloy, cold deformation of the coated strip, possible cutting of the excess sheet with a view to the final geometry of the part, heating of the part so as to form an intermetallic compound from the steel/precoat interface and to austenitize the steel, transfer of the part to a tool and cooling of the part in the tool at a rate such that the steel has, after being cooled, a martensitic or bainitic structure or a martensite-bainite structure. The precoating is carried out by electroplating, by chemical or physical vapor deposition or by co-rolling.

12 Claims, 2 Drawing Sheets

METHOD FOR MAKING A COATED STEEL PART HAVING VERY HIGH RESISTANCE AFTER HEAT TREATMENT

The invention relates to the manufacture of hot-rolled or cold-rolled coated steel parts, having a high mechanical strength and good corrosion resistance.

For some applications, it is desired to produce steel parts that combine high mechanical strength, good impact strength and good corrosion resistance. This type of combination is particularly desirable in the automobile industry in which the objective is to produce significantly lighter vehicles. This may in particular be achieved by using steels having very high mechanical properties, for anti-intrusion, structural or safety parts of motor vehicles (fender cross-members, door or centre pillar reinforcements, wheel arms) require, for example, the abovementioned qualities.

Patent FR 2 807 447 discloses a manufacturing process in which a base steel sheet is supplied with a metal precoat, the steel possessing a tensile strength of around 500 MPa, a cold-forming operation, for example cold drawing or profiling, is carried out and then a heat treatment is carried out for the purpose of subsequently quenching the sheet in a tool of shape matched to the geometry of the part. During the heating phase of this heat treatment, an intermetallic coating is formed on the surface of the part by the initial precoat alloying with the base steel. In this way, corrosion-resistant parts with for example a mechanical strength of greater than 1500 MPa are obtained.

The base steel sheet may be precoated with aluminum or with an aluminum alloy by a hot-dip coating process. However, in certain cases limitations in the implementation of this process are encountered. During cold-forming operations carried out on the part before heat treatment, certain zones may be subjected to severer deformation, and the interface between the substrate and the precoat may possibly suffer damage in the form of local debonding. In this case, the subsequent heat treatment may result in the formation of scale in the vicinity of the interfacial alloy layer. The presence of this scale is deleterious to satisfactory alloying between the base steel and the aluminum-containing precoat.

Moreover, after the aluminized parts have been cold-formed, they may be cut, punched or trimmed, for the purpose of removing excess material before the subsequent alloying heat treatment. The presence of the hot-dip-coated aluminum-based precoat may contribute to the cutting tool wearing out.

Furthermore, the precoat of hot-dipped aluminized sheets may have a variation in thickness relative to the standard thickness. The heating during the alloying heat treatment is carried out quite rapidly, typically in a few minutes, so that should there be an excessive overthickness there would be incomplete alloying of the coat. Since the melting point of the usual precoats is 660° C. in the case of aluminum, or 580° C. in the case of a 10% silicon/aluminum alloy, there may be premature melting on the thicker side of the coat before the part reaches the austenization temperature. As the heat treatments are generally carried out in furnaces in which the parts are moved along rollers, the surface of the latter is contaminated with a layer coming from the partial melting of the precoat, to the detriment of correct operation of the furnaces. Furthermore, incomplete alloying of the precoat is deleterious during subsequent cataphoresis operations.

The object of the present invention is to solve the abovementioned problems. In particular, the aim of the invention is to provide a process for manufacturing hot-rolled or cold-rolled steel parts precoated with aluminum or with an aluminum alloy, allowing substantial prior cold deformation before the alloying treatment without, as a consequence, any subsequent risk regarding the alloying treatment. The aim of the invention is to reduce wear of the tool during mechanical machining before the alloying heat treatment. The aim of the invention is also to obtain, after heat treatment, complete alloying of the aluminum or aluminum alloy precoat.

For this purpose, the subject of the invention is a process for manufacturing a part having very high mechanical properties from a hot-rolled or cold-rolled steel strip, comprising the following successive steps:

- the strip is precoated with aluminum or an aluminum alloy. This precoating may be carried out by one or more steps according to the methods given below, by themselves or in combination:
  - precoating by one or more aluminum or aluminum alloy electroplating steps,
  - precoating by one or more aluminum or aluminum alloy chemical vapor deposition steps,
  - precoating by one or more aluminum or aluminum alloy physical vapor deposition steps,
  - precoating by one or more co-rolling steps, in which the steel strip is co-rolled with an aluminum or aluminum alloy foil,
  - the interface between the steel strip and the precoat having no intermetallic phase thanks to the implementation of these precoating methods;
- the coated strip is cold-deformed;
- excess sheet is possibly removed, in view of the final geometry of said part;
- the part is heated, for example in a furnace, so as to form an intermetallic compound on the surface of the part starting from the steel/precoat interface and to austenitize the steel. During the heating phase of this heat treatment, an intermetallic coating is formed on the surface of the part by the initial precoat layer alloying with the base steel, this alloying being carried out over the entire thickness of the precoat layer; and
- after heating, the part is transferred to a tool. The transfer time between the heating phase and the part coming into contact with the tool is short enough for no transformation of the austenite to take place during this period of time. The geometry and the design of the tool are tailored both to the part to be treated and to the severity of the quench. In particular, these tools may be cooled, especially by circulation of fluid, in order to increase the productivity of the operations and/or to increase the severity of the quench. A clamping force may provide intimate contact between the parts and the tool, thus allowing effective cooling by conduction and minimal deformation. The part is cooled in the tool at a rate such that the steel has, after being cooled, a martensitic or bainitic structure or a martensite-bainite structure.

In one particular method of implementation, the generalized strain of the cold deformation is greater than 20%, at least at one point in the part.

The subject of the invention is also the use of a part having very high mechanical properties obtained from a steel strip manufactured according to one of the above methods of implementation, in order to manufacture structural or safety parts for land motor vehicles.

Other features and advantages of the invention will become apparent over the course of the description below, given by way of example, in which.

The variation in the steel/coating interface during a conventional manufacturing process was examined. For this purpose, steel parts 1.2 or 2 mm in thickness were considered, these having the following composition by weight:

carbon: 0.15 to 0.25%;
manganese: 0.8 to 1.5%;
silicon: 0.1 to 0.35%;
chromium: 0.01 to 0.2%;
titanium <0.1%;
phosphorus: <0.05%;
sulfur: <0.03%; and
B: 0.0005% to 0.01%.

These parts were precoated using a conventional hot-dip process, in which they were dipped into an aluminum-based bath comprising:

silicon: 9-10%;
iron: 2 to 3.5%, the balance consisting of aluminum and inevitable impurities.

Figure 1:
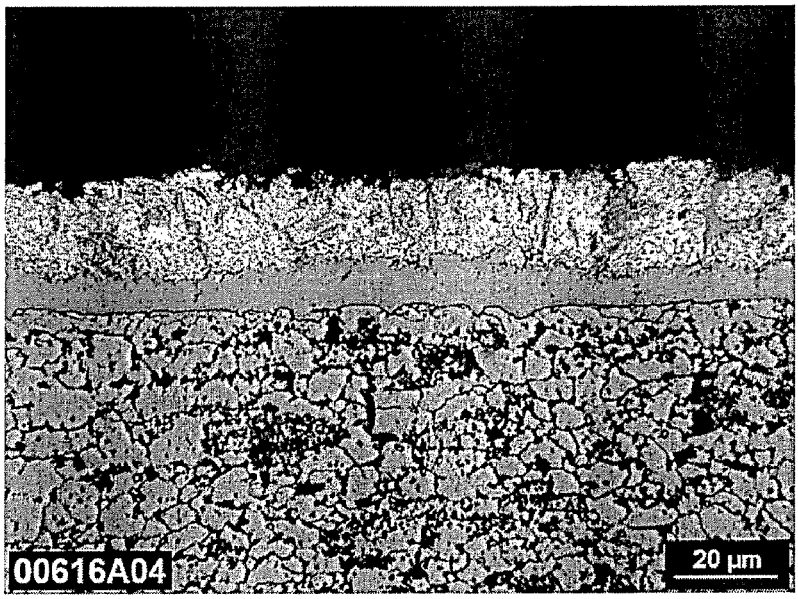
FIG. 1 shows an example of a steel/hot-dip-coated aluminum alloy interface, before cold deformation.

It is known that bringing a steel into contact with a pure aluminum bath at above 660° C. results in the very rapid formation of a thick layer of intermetallic alloy, especially one comprising $FeAl_3$—$Fe_2Al_5$. Since this layer has a low deformability, a 10% addition of silicon to the bath makes it possible to reduce the thickness of this intermediate layer. FIG. 1 shows that the intermetallic layer, with a Vickers hardness of 600 to 800, has a thickness of about 7 microns, this layer being surmounted by an aluminum-based metal layer about 15 microns in thickness.

The precoated parts were subjected to a cold deformation on Nakazima-type test pieces, these being stressed in various modes, namely in uniaxial tension and in equibiaxial expansion. The principal strains $\epsilon_1$ and $\epsilon_2$, that is to say the strains in a principal reference strain, were measured at various points by means of circularly patterned grids photodeposited beforehand. The generalized strain, $$\bar{\varepsilon} = \frac{2}{\sqrt{3}}\sqrt{(\varepsilon_1^2 + \varepsilon_1\varepsilon_2 + \varepsilon_2^2)}$$

relating to these various points was deduced therefrom.

Figure 2:
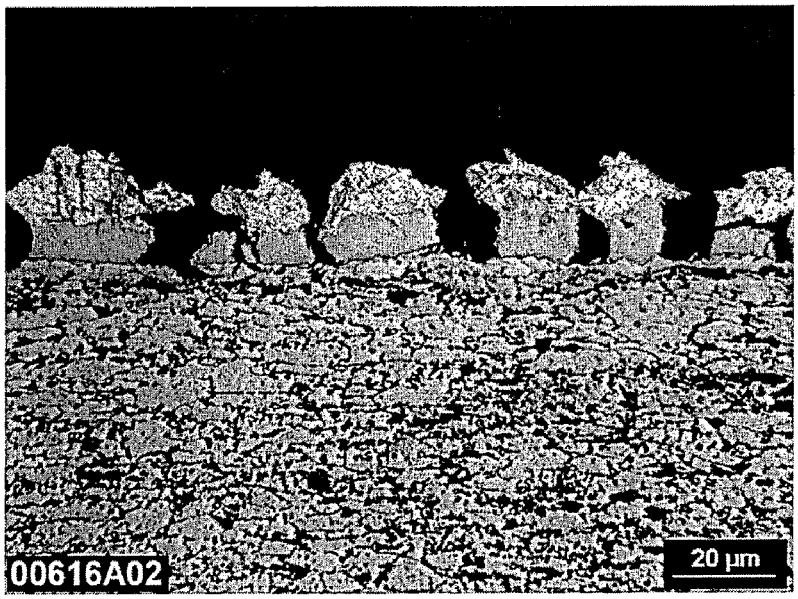
FIG. 2 shows the variation in this interface after a cold generalized strain of greater than 20%.
Figure 3:
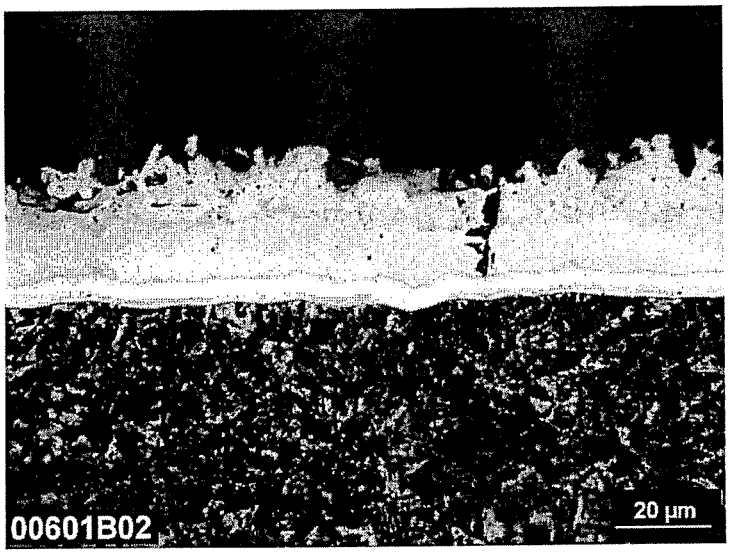
FIG. 3 shows an example of a steel/hot-dip-coated aluminum alloy interface, without cold deformation, after alloying treatment.
Figure 4:
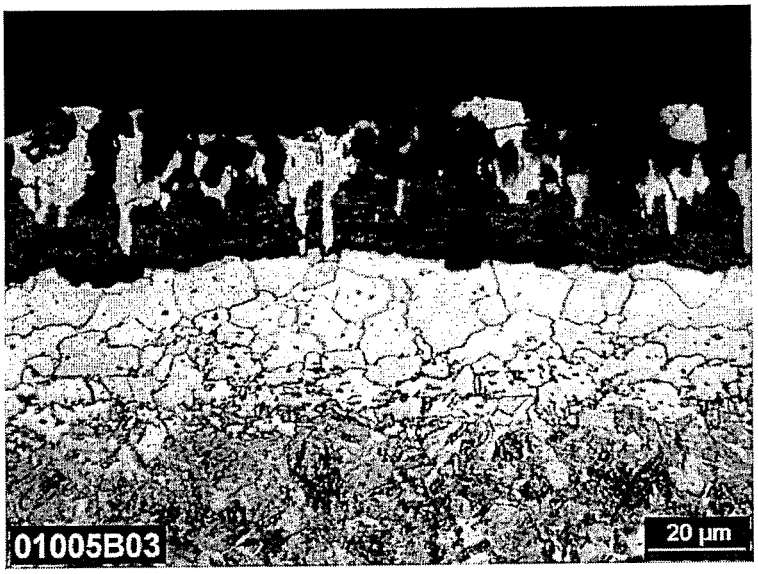
FIG. 4 illustrates the surface layer after cold deformation of greater than 20%, followed by an alloying treatment.

At the same time, the behavior of the precoat was observed at these various locations. The observations show that, up to a generalized strain of around 10%, the intermediate layer is finely and regularly cracked, but without affecting the aluminum metal upper layer surmounting it. A subsequent heat treatment in a furnace at 900° C. for 5 to 7 minutes, followed by a quench in a water-cooled tool results in complete alloying of the initial precoat and in the disappearance of this limited network of cracks (FIG. 3). Above 20% generalized strain, the intermetallic layer fragments (FIG. 2) and, in places, the aluminum-based metal coat degrades. The subsequent alloying heat treatment may then cause a scale layer to grow or may cause the surface of the steel to decarburize (FIG. 4), this being deleterious to subsequent processing of the part, for example to painting.

Thus, implementation of the cold-deformation process with a high strain may result in difficulties with a conventional aluminum-based precoat. Within the context of the invention, it has been demonstrated that this problem is solved when the steel/aluminum interface contains no intermetallic phase. This is because, owing to the intrinsic ductility of the aluminum or of the aluminum alloy, due to its face-centred cubic structure, substantial cold deformation of a precoated steel does not lead to any degradation of the interface or of the precoat, so that the subsequent alloying treatment takes place under optimum conditions.

The aluminum or aluminum alloy precoat is formed by electroplating, or by physical or chemical vapor deposition, or by co-rolling, a steel strip being co-rolled with an aluminum or aluminum alloy foil. These various steps thus result in a part with no intermetallic layer between the base steel and the precoat before the alloying treatment. The process according to the invention may be carried out by applying the same precoating step in a single pass, or by applying it in several passes. Likewise, the process according to the invention may be carried out by combining various precoating steps in succession so as to exploit the advantages intrinsic to the various methods and to the various characteristics of the coatings deposited.

Application of the process according to the invention makes it easier to carry out a cutting, punching or trimming operation on the parts after the cold-forming operation. This is because an intermediate machining step may prove to be useful for the purpose of reducing the volume of metal to be reheated in the alloying treatment. According to the invention, this intermediate machining is facilitated by the absence of the hard (600 to 800 HV) intermetallic layer that is encountered in the conventional process. In this way, the wear of the cutting tools is reduced.

Moreover, the precoating steps according to the invention provide coatings deposited with great thickness regularity. For example, the precoating conditions using vapor deposition may provide coatings having a thickness ranging between 15 and 20 micrometers with a thickness variation of the order of one micrometer.

Depending on the hot-dip aluminizing process, the thickness variation of the precoat measured on a micrographic section may be of the order of ±10 micrometers for a mean thickness of 25 micrometers. For the purpose of maximizing productivity, it is desirable for the heating during the alloying heat treatment to take place as rapidly as possible. Finding that there is an overthickness may result in the heating phase being extended, in order for the alloying to be complete. For a given heat treatment, not knowing that there is an excessive overthickness may have the consequence that the alloying is incomplete, resulting in partial melting of the precoat.

The precoating step according to the invention results in low thickness variability, thereby reducing the risk of melting and increasing the operational stability of the furnaces.

Moreover, after austenization, the quench cooling treatment in a tool gives the steel a martensitic or bainitic structure or a martensite-bainite structure. Depending on the composition of the steel, in particular its carbon content, and also its manganese, chromium and boron contents, the maximum strength obtained on the parts according to the invention varies from 1200 to 1700 MPa.

According to the invention, since the cutting is carried out more cleanly because of the absence of an intermetallic layer, the notch effect at the edge of the cut is less after the quench treatment since it is known that fully or partially martensitic structures are intrinsically more sensitive to local stress concentration effects.

Thus, the invention makes it possible to manufacture coated parts of high properties, with more complex shapes, since the cold deformation may reach high levels. The invention is implemented particularly advantageously when the degree of generalized strain of the cold deformation prior to the alloying treatment is greater than 20%, it makes it possible to reduce tool wear during intermediate cutting operations, and it results in greater effectiveness of the final alloying treatment.

The invention claimed is:

1. A process for manufacturing a part having very high mechanical properties from a hot-rolled or cold-rolled steel strip comprising a steel, the process comprising the following successive steps:

said steel strip is precoated with a precoat comprising aluminum or an aluminum alloy to obtain a coated strip having a steel/precoat interface;

said coated strip is cold-deformed to obtain a cold-deformed part;

optionally a portion is removed from said cold-deformed part;

said cold-deformed part is heated so as to form an intermetallic compound starting from the steel/precoat interface and to austenitize the steel and thus obtain a heated part;

said heated part is transferred to a tool; and said heated part is cooled in the tool to obtain a cooled part at a rate such that the steel in the cooled part has a quenched structure selected from the group consisting of a martensitic structure, a bainitic structure and a martensite-bainite structure, wherein the cooled part comprises an intermetallic coating on the steel having a quenched structure; and before said cold-deformed part is heated, the steel/precoat interface does not contain an intermetallic phase; and said precoat is formed by at least one aluminum or aluminum alloy electroplating step, by at least one aluminum or aluminum alloy chemical vapor deposition step, by at least one aluminum or aluminum alloy physical vapor deposition step, by at least one co-rolling step in which said steel strip is co-rolled with an aluminum or aluminum alloy foil, or by a combination of any two or more of said steps.

2. The manufacturing process as claimed in claim 1, wherein a generalized strain, given by $(2/\sqrt{3})\sqrt{(\epsilon_1^2+\epsilon_1\epsilon_2+\epsilon_2^2)}$, where $\epsilon_1$ and $\epsilon_2$ are principal strains, of said cold deformation is greater than 20%, at least at one point in said part.

3. The manufacturing process as claimed in claim 1 or 2, wherein the cooled part is selected from the group consisting of structural and safety parts for land motor vehicles.

4. The manufacturing process as claimed in claim 1, wherein said precoat is formed by the at least one aluminum or aluminum alloy electroplating step.

5. The manufacturing process as claimed in claim 1, wherein said precoat is formed by the at least one aluminum or aluminum alloy chemical vapor deposition step.

6. The manufacturing process as claimed in claim 1, wherein said precoat is formed by the at least one aluminum or aluminum alloy physical vapor deposition step.

7. The manufacturing process as claimed in claim 1, wherein said precoat is formed by the at least one co-rolling step in which said steel strip is co-rolled with an aluminum or aluminum alloy foil.

8. The manufacturing process as claimed in claim 1, wherein the portion is removed from said cold-deformed part by a cutting, punching or trimming operation.

9. The manufacturing process as claimed in claim 1, wherein after said cold-deformed part is heated said heated part is transferred to the tool in a transfer time short enough so that no transformation of austenite in the steel takes place during the transfer time.

10. The manufacturing process as claimed in claim 1, wherein the tool is cooled by circulation of fluid.

11. The manufacturing process as claimed in claim 1, wherein when said heated part is cooled in the tool a clamping force provides intimate contact between the heat part and the tool.

12. The manufacturing process as claimed in claim 1, wherein the cooled part consists of the intermetallic coating on the steel having a quenched structure.

* * * * *